US009865443B2

(12) United States Patent
Taniguchi

(10) Patent No.: US 9,865,443 B2
(45) Date of Patent: Jan. 9, 2018

(54) MASS ANALYSIS METHOD AND INDUCTIVELY COUPLED PLASMA MASS SPECTROMETER

(71) Applicant: SHIMADZU CORPORATION, Kyoto (JP)

(72) Inventor: Tadashi Taniguchi, Shiga Pref. (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 15/448,600

(22) Filed: Mar. 3, 2017

(65) Prior Publication Data

US 2017/0256388 A1 Sep. 7, 2017

(30) Foreign Application Priority Data

Mar. 4, 2016 (JP) ..... 2016-042885

(51) Int. Cl.
*H01J 49/10* (2006.01)
*H01J 49/00* (2006.01)

(52) U.S. Cl.
CPC ..... *H01J 49/105* (2013.01); *H01J 49/0031* (2013.01); *H01J 49/0036* (2013.01)

(58) Field of Classification Search
USPC ..... 250/281, 282
See application file for complete search history.

(56) References Cited

U.S. PATENT DOCUMENTS

2014/0097338 A1* 4/2014 Eiler ..... H01J 49/0009 250/282

FOREIGN PATENT DOCUMENTS

JP 2000-100374 4/2000

* cited by examiner

*Primary Examiner* — Kiet T Nguyen
(74) *Attorney, Agent, or Firm* — JCIPRNET

(57) ABSTRACT

An Inductively Coupled Plasma Mass Spectrometer including: a plasma ionization part; a mass analysis part; a storage part that stores ion information about mass-charge ratios and presence ratios of isotopic ions of all elements and mass-charge ratios and generation probabilities of compound ions and multivalent ions generated when the measuring object samples are plasma-ionized; a representative sample measuring part; and an element-containing inferring part that infers types of elements contained in the representative sample; an interference ion judgment part that, respective target elements in the inferred elements, judges according to ion information whether there are isotopes without interference ions; a determination part of measurement mass-charge ratio that determines the mass-charge ratio of the isotope without interference ions and a mass-charge ratio of an isotope whose a mass peak has the maximum intensity obtained by subtracting the intensity as a mass-charge ratio for measurement; and an all-sample measuring part.

10 Claims, 7 Drawing Sheets

| Isotope | Mass | Presence ratio (%) |
|---|---|---|
| $^{106}Cd$ | 105.906458 | 1.25 |
| $^{108}Cd$ | 107.904183 | 0.89 |
| $^{110}Cd$ | 109.903006 | 12.49 |
| $^{111}Cd$ | 110.904182 | 12.8 |
| $^{112}Cd$ | 111.9027577 | 24.13 |
| $^{113}Cd$ | 112.9044014 | 12.22 |
| $^{114}Cd$ | 113.9033586 | 28.73 |
| $^{116}Cd$ | 115.904756 | 7.49 |

FIG. 2

MASS ANALYSIS METHOD AND INDUCTIVELY COUPLED PLASMA MASS SPECTROMETER

CROSS-REFERENCE TO RELATED APPLICATION

This application claims the priority benefit of Japan patent application serial no. 2016-042885, filed on Mar. 4, 2016. The entirety of the above-mentioned patent application is hereby incorporated by reference herein and made a part of the specification.

BACKGROUND OF THE INVENTION

1. Field of the Invention

The present invention relates to a mass analysis method and an Inductively Coupled Plasma Mass Spectrometer (ICP-MS) generating atomic ions from samples through an ICP and performing mass analysis.

2. Description of Related Art

One of the devices that analyze elements containing in samples is an ICP-MS (e.g., Patent Document 1). The ICP-MS has the following strong points: for a wide range of elements for lithium to uranium (except for some elements such as rare gas), ng/L-degree ultramicro elements may be detected through ppt (parts per trillion) level analysis, for example, for quantifying many harmful metals (heavy metal elements) contained in environmental samples such as tap water or river water, and land, or quantifying many elements contained in food and drugs.

The ICP-MS has a plasma ionization part that generates atomic ions from samples (mainly liquid samples), through an ICP, and a mass analysis part that analyzes the generated atomic ions. The plasma ionization part has a plasma torch which has a sample gas tube for circulation of a sample gas, a plasma gas tube formed on the periphery of the sample gas tube, a cooling gas tube formed on the periphery of the plasma gas tube, and a high-frequency induction coil wound to a front end of the cooling gas tube. If a plasma gas such as argon flows in and a high-frequency current flows towards the high-frequency induction coil of the plasma torch, a plasma (6,000 K-10,000 K high-temperature plasma) is generated at the front end of the plasma torch. If a sample (e.g., an atomized liquid sample obtained through an atomizing gas) is introduced from the sample gas tube in the state, in the high-temperature plasma, compounds in the sample are atomized and ionized, to generate atomic ions. The generated atomic ions are guided to the mass analysis part and separated corresponding to mass-charge ratios.

In the ICP-MS, it is common to sequentially continuously analyze multiple (e.g., about 100) samples selected under the same or similar conditions with the same condition, and quantify about 20-30 target elements contained in each sample. Herein, the program of continuously analyzing multiple samples in the ICP-MS is described.

Firstly, one of the multiple samples is selected as a representative sample to be introduced into the plasma ionization part, and scanning measurement is carried out on the atomic ions generated from the representative sample. Accordingly, a mass spectrum of the representative sample can be obtained.

Secondly, the analyzer confirms the mass spectrum, infers elements contained in the representative sample according to the position (mass-charge ratio) of a mass peak in the mass spectrum, and extracts target elements (e.g., heavy metal elements) therefrom. (Natural) isotopes are present in many elements, and the presence ratio thereof is also known. Therefore, for an element, if a mass peak appears in the position of the mass-charge ratio corresponding to all isotopic ions, it may be inferred that the sample contains the element.

Then, the analyzer, for all the target elements, determines, from isotopic ions with different mass-charge ratios, through which isotopic ion (mass-charge ratio) the element is measured. At this point, when there are isotopes without other ions (hereinafter referred to as "interference ions") with the same mass-charge ratio (i.e., a mass peaks of other ions do not overlap), the isotopes are used for measurement. The other ions (interference ions) herein include: other element ions (isobar ions), compound ions (oxide ions, chloride ions, plasma gas adduct ions, etc.), and multivalent ions. On the other hand, when interference ions are present in all isotopes of the target elements, isotopes with a small number of interference ions or small intensity of overlapping a mass peaks are used for measurement.

If isotopes for measurement are determined for all the target elements respectively according to the mass spectrum of the representative samples, target elements contained in each sample are measured through Selected Ion Monitoring (SIM) measurement using a mass-charge ratio (referred to as "measurement mass-charge ratio"), and the element is quantified according to intensity of a mass peaks of the target elements. SIM measurement using the measurement mass-charge ratio determined according to the mass spectrum of the representative sample is performed on multiple samples, and the target elements contained in the samples are quantified.

DOCUMENT OF THE PRIOR ART

Patent Document

Patent Document 1: Japanese Patent Gazette No. 2000-100374

SUMMARY OF THE INVENTION

Problem to be Solved in the Invention

As stated above, the analyzer determines isotopes for measurement for each target element. In determination of the isotopes, it may be easier to judge whether isobars are present in the interference ions. However, regarding the compound ions or multivalent ions, it is difficult to grasp the ions generated during ionization of the sample but for a skilled analyzer. Therefore, the following problem exists: due to the analyzer's degree of proficiency, there is a situation where isotopes for measurement are different and deviate in quantitative results.

The problem to be solved in the present invention is to provide a mass analysis method and an ICP-MS that can correctly quantify target elements contained in multiple measuring object samples regardless of the degree of proficiency of an analyzer.

Technical Means of Solving the Problem

To solve the problem, a first aspect of the present invention is a mass analysis method, which is a method that uses an ICP-MS to measure pre-determined one or more target elements for multiple measuring object samples, the ICP-MS having a plasma ionization part that plasma-ionizes the measuring object samples through an ICP and a mass analysis part that mass-separates ions generated in the plasma ionization part and detects the ions, wherein the mass analysis method includes:

plasma-ionizing, in the plasma ionization part, a representative sample as one of the multiple measuring object samples, and obtaining a mass spectrum by scanning measurement in the mass analysis part, inferring types of elements contained in the representative sample according to the position of a mass peak of the representative sample, for respective ones of the target elements in the inferred elements, judging according to ion information whether there are isotopes without interference ions, wherein the ion information is information about mass-charge ratios and presence ratios of isotopic ions of all elements assumptively contained in the measuring object samples, which contain the target elements, and mass-charge ratios and generation probabilities of compound ions and multivalent ions assumptively generated when the measuring object samples are plasma-ionized, and the interference ions are other ions having a mass-charge ratio identical with that of monovalent ions of the target elements, when there are the isotopes without the interference ions, determining the mass-charge ratio of the isotope whose a mass peak has the maximum intensity as a measurement mass-charge ratio being a mass-charge ratio for measurement of the target elements, and when the interference ions are present in all the isotopes, based on the ion information, calculating intensity of the mass peak of the interference ions according to detection intensity of monovalent ions of interference elements, and determining a mass-charge ratio of an isotope whose a mass peak has the maximum intensity obtained by subtracting the intensity as a measurement mass-charge ratio being a mass-charge ratio for measurement, wherein the interference elements are elements corresponding to the interference ions, and sequentially introducing the multiple measuring object samples into the plasma ionization part, and performing SIM measurement, which uses the measurement mass-charge ratio, on each sample.

In addition, to solve the problem, a second aspect of the present invention is an ICP-MS, for measuring pre-determined one or more target elements for multiple measuring object samples, the ICP-MS including:

a) a plasma ionization part that plasma-ionizes the measuring object samples through an ICP;

b) a mass analysis part that mass-separates ions generated in the plasma ionization part and detects the ions;

c) a storage part that stores ion information, wherein the ion information is information about mass-charge ratios and presence ratios of isotopic ions of all elements assumptively contained in the measuring object samples, which contain the target elements, and mass-charge ratios and generation probabilities of compound ions and multivalent ions assumptively generated when the measuring object samples are plasma-ionized;

d) a representative sample measuring part that plasma-ionizes, in the plasma ionization part, a representative sample as one of the multiple measuring object samples, and obtains a mass spectrum by scanning measurement in the mass analysis part;

e) an element-containing inferring part that infers types of elements contained in the representative sample according to the position of a mass peak of the representative sample;

f) an interference ion judgment part that, for respective ones of the target elements in the inferred elements, judges according to ion information whether there are isotopes without interference ions, wherein the interference ions are other ions having a mass-charge ratio identical with that of monovalent ions of the target elements;

g) a determination part of measurement mass-charge ratio that, when there are the isotopes without the interference ions, determines the mass-charge ratio of the isotope whose a mass peak has the maximum intensity as a measurement mass-charge ratio being a mass-charge ratio for measurement of the target elements, and when the interference ions are present in all the isotopes, based on the ion information, calculates intensity of the mass peak of the interference ions according to detection intensity of monovalent ions of interference elements, and determines a mass-charge ratio of an isotope whose a mass peak has the maximum intensity obtained by subtracting the intensity as a measurement mass-charge ratio being a mass-charge ratio for measurement, wherein the interference elements are elements corresponding to the interference ions; and h) an all-sample measuring part that sequentially introduces the multiple measuring object samples into the plasma ionization part, and performs SIM measurement, which uses the measurement mass-charge ratio, on each sample.

Ion information is used in the mass analysis method and the ICP-MS of the present invention, wherein the ion information is information about mass-charge ratios and presence ratios of isotopic ions of all elements assumptively contained in the measuring object samples, and mass-charge ratios and generation probabilities of compound ions and multivalent ions assumptively generated when the measuring object samples are plasma-ionized. The compound ions assumptively generated when the measuring object samples are plasma-ionized, for example, include: oxide ions, chloride ions, and argon adduct ions. The information about the mass-charge ratios of the compound ions may be the mass-charge ratios of the compound ions per se, or differences between mass-charge ratios of the interference ions and mass-charge ratios of monovalent ions of interference elements (e.g., which is 16 in the case of oxide ions). If the latter information and mass-charge ratios of isotopic ions of the respective elements are combined, mass-charge ratios of compound ions generated from all elements can be calculated with less information amount.

When the measuring object samples are measured, at first, scanning measurement is performed on a representative sample as one of the multiple measuring object samples, to obtain a mass spectrum of the representative sample. In the mass spectrum, if a peak value occurs in the position of a mass-charge ratio corresponding to a monovalent ion of an element contained in the representative sample, and in addition, when multiple isotopes are present in the element, peak values occur respectively in positions of mass-charge ratios corresponding to the multiple isotopes. Accordingly, the type of the element contained in the representative sample is inferred according to the position of the mass peak.

Mass peaks of isobar ions, compound ions of other elements or multivalent ions of other elements or compounds (interference ions) may overlap on the mass peak of the target element of the mass spectrum of the representative sample. Therefore, for respective ones of the target elements with multiple isotopes, whether interference ions are present in the respective isotopic ions is judged according to ion information. Moreover, when where are isotopes without interference ions, the mass-charge ratio of the isotope whose a mass peak has the maximum intensity is determined as a mass-charge ratio for measurement of the element (measurement mass-charge ratio). On the other hand, when interference ions are present in all the isotopes, intensity of the mass peak of the interference ions (interference intensity) overlap on the mass peak of the respective isotopic ions is calculated according to presence ratios of isotopes of other elements and generation probabilities of compound ions and monovalent ions contained in the ion information, and a mass-charge ratio of an isotope whose a mass peak has the maximum intensity (i.e., pure a mass peak intensity of the target element) obtained by subtracting the intensity of the mass peak of the interference ions from intensity of the mass peak at the measurement mass-charge ratio (actually measured intensity) is determined as a measurement mass-charge ratio.

If the measurement mass-charge ratios of the respective target elements are determined in the above manner, the respective target elements contained in multiple measuring object samples are measured through SIM measurement using the measurement mass-charge ratios.

In this way, in the mass analysis method and the ICP-MS of the present invention, after the mass spectrum of the representative sample is obtained, whether there are interference ions is judged according to prepared ion information, and then the most suitable measurement mass-charge ratio is determined. Therefore, SIM measurement using the most suitable measurement mass-charge ratio can be performed regardless of the analyzer's degree of proficiency, and the respective target elements contained in the measuring object samples can be quantified correctly.

In the mass analysis method of the present invention, preferably, regarding the measurement mass-charge ratio of the target element, when an interference ion is present, the selected ion monitoring is also performed on a mass-charge ratio of other monovalent ion corresponding to the interference ion, and based on the ion information, detection intensity of the interference ions are inferred according to detection intensity of the other monovalent ions corresponding to the interference ions, and modified intensity as intensity obtained by subtracting intensity of a mass peak of the interference ion from intensity of a mass peak of an ion of the mass-charge ratio of the target element is calculated.

Herein, the so-called other monovalent ions corresponding to the interference ions, refer to monovalent atomic ions of elements forming the compound when the interference ions are compound ions, and refer to monovalent compound ions generated from the atomic ions when the interference ions are monovalent atomic ions.

As stated above, SIM measurement is also performed on mass-charge ratios of monovalent ions of interference elements corresponding to interference ions, detection intensity of the interference ions is inferred, and modified intensity obtained by subtracting the interference ions from actually measured intensity of a mass peaks of ions of mass-charge ratios of target elements is calculated, and thus the actually measured intensity can be modified automatically without bothering the analyzer, and intensity of a mass peaks of the target elements is obtained easily.

However, even if multiple measuring object samples for determination are selected with the same or similar conditions, types of elements contained in the measuring object samples are not necessarily completely the same. That is, there is a situation where types of elements contained in the representative sample are different from those of elements contained in the other measuring object samples (especially containing elements not contained in the representative sample), sometimes the elements (or the compound ions or multivalent ions of the elements) may produce interference beyond assumption. Specifically, in determination of the measurement mass-charge ratio, although it is determined as a mass-charge ratio without interference ions, when interference ions are present, the interference ions may become interference ions beyond assumption. Besides, when interference ions, whose types are different those of the interference ions considered in the determination of the measurement mass-charge ratio, are present, the interference ions may also become interference ions beyond assumption.

Therefore, in the mass analysis method of the present invention, preferably, a mass spectrum is obtained also by scanning measurement on measuring object samples other than the representative sample, according to the obtained mass spectrum and the ion information for each measuring object sample, it is judged, for respective ones of the target elements, whether an interference ion beyond assumption is present in determination of the measurement mass-charge ratio by the determination part of measurement mass-charge ratio, and when at least one of the target elements has the interference ion beyond assumption, information of urging remeasurement is prompted to an analyzer for the measuring object sample.

In the MS, according to the obtained mass spectrum and the ion information for each measuring object sample, it is judged, for respective ones of the target elements, whether an interference ion beyond assumption is present in determination of the measurement mass-charge ratio. At this point, if it is judged that the interference ion beyond assumption is not present, regarding the measuring object sample, it can be guaranteed that all the measurement mass-charge ratios corresponding to the respective target components are suitable, and a quantitative result with high reliability can be obtained according to ion intensity obtained through SIM measurement. On the other hand, when it is judged that interference ions beyond assumption are present, it is likely that the quantitative result may produce errors due to the presence of the interference ions. Therefore, in the mass analysis method, the situation may prevent that target components are mistaken for quantification due to urging the analyzer for remeasurement.

As the method for prompting the information of urging remeasurement, various methods such as image output and sound output can be used.

In addition, in the mass analysis method, preferably, when it is judged for a target element that the interference ion beyond assumption is present in determination of the measurement mass-charge ratio, a changed mass-charge ratio as a new mass-charge ratio for measurement of the target element is determined and prompted to the analyzer according to the mass spectrum of the measuring object sample and the ion information.

In addition, the mass analysis method can also be formed by:

prompting the changed mass-charge ratio, quantifying the target element according to intensity of a mass peak of the changed mass-charge ratio in the mass spectrum of the measuring object sample, and prompting a quantitative value thereof as a temporary quantitative value.

Effects of the Invention

By use of the mass analysis method or the ICP-MS of the present invention, target elements contained in the respective ones of multiple measuring object samples can be quantified correctly regardless of the analyzer's degree of proficiency.

BRIEF DESCRIPTION OF THE DRAWINGS

FIG. 2 is an example of ion information used in this embodiment.

DESCRIPTION OF THE EMBODIMENTS

Embodiments of a mass analysis method and an ICP-MS of the present invention are described below with reference to drawings.

Figure 1:
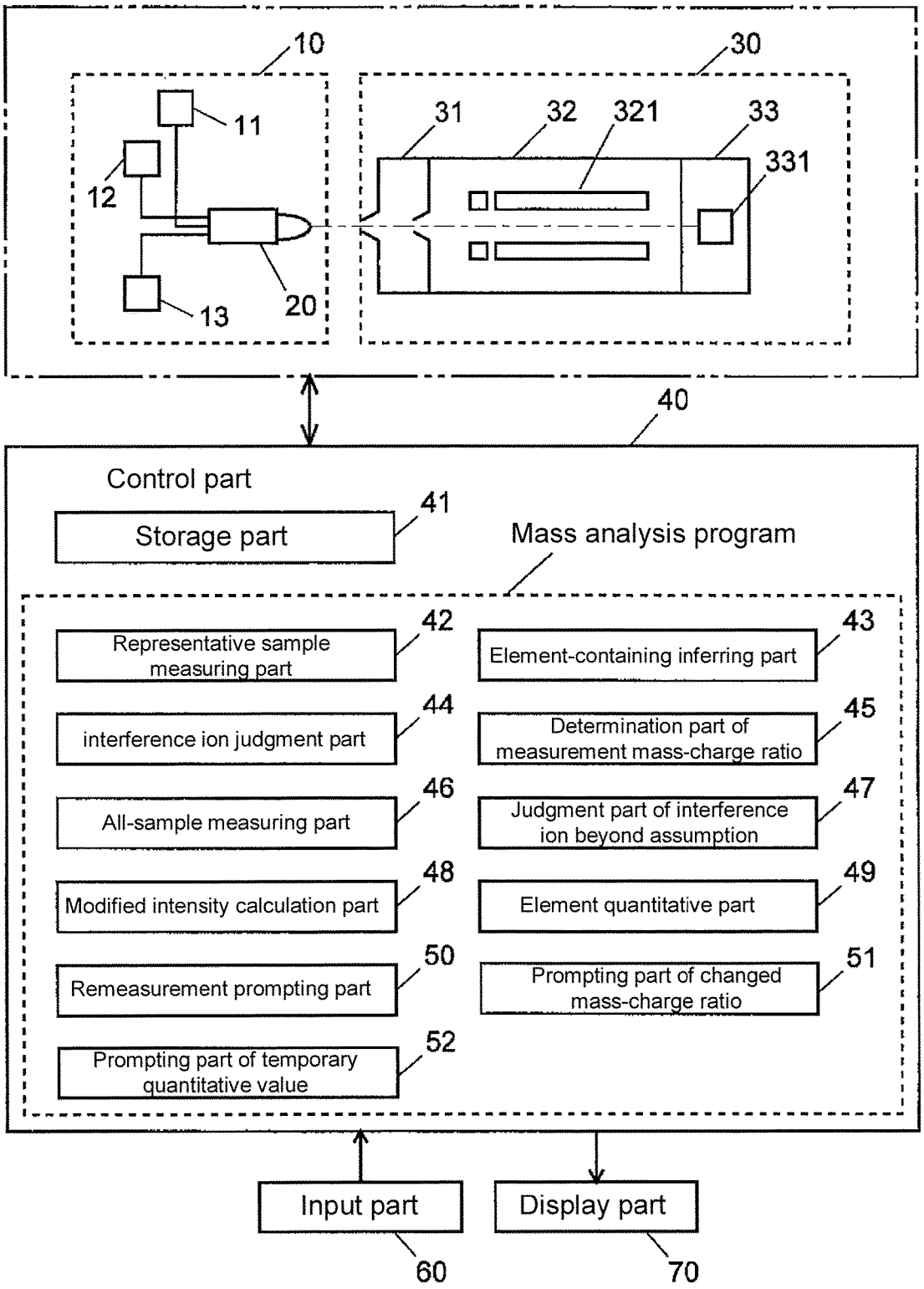
FIG. 1 is a diagram of main components of an embodiment of an ICP-MS according to the present invention.

FIG. 1 is a diagram of main components of an ICP-MS of this embodiment. The ICP-MS substantially consists of a plasma ionization part 10, a mass analysis part 30, and a control part 40.

The plasma ionization part 10 includes: a plasma torch 20, internally provided with a sample gas tube for circulation of a sample gas, a plasma gas tube formed on the periphery of the sample gas tube, a cooling gas tube formed on the periphery of the plasma gas tube; an automatic sampler 11 that introduces a liquid sample into the sample gas tube; an nebulized gas supply source 12 that supplies nebulized gas in the sample gas tube to nebulize the liquid sample; a plasma gas (argon) supply source 13; and a cooling gas supply source (not shown) that supplies cooling gas into the cooling gas tube.

The mass analysis part 30 includes: a first vacuum chamber 31, provided with a skimmer at an inlet opposite the front end of the plasma torch 20; a second vacuum chamber 32, provided with a skimmer between it and the first vacuum chamber 31 and internally provided with a quadrupole mass filter 321; and a third vacuum chamber 33 provided with a detector 331 that detects ions separated through the quadrupole mass filter 321.

The control part 40, in addition to a storage part 41, has a representative sample measuring part 42, an element-containing inferring part 43, an interference ion judgment part 44, a determination part of measurement mass-charge ratio 45, an all-sample measuring part 46, a judgment part of interference ion beyond assumption 47, a modified intensity calculation part 48, an element quantitative part 49, a remeasurement prompting part 50, a prompting part of changed mass-charge ratio 51, and a prompting part of temporary quantitative value 52 as function blocks. The entity of the control part 40 is a personal computer, which executes a specified program (program for mass analysis) through a Central Processing Unit (CPU), thus making the function blocks concrete. In addition, the control part 40 is connected with an input portion 60 such as a keyboard or mouse, and a display portion 70 such as an LED.

The storage part 41 stores ion information, wherein the ion information is information about mass-charge ratios and (natural) presence ratios of isotopic ions of all elements, and mass-charge ratios and generation probabilities of compound ions and multivalent ions assumptively generated when the samples are plasma-ionized. Here, the compound ions, for example, include: oxide ions, hydroxide ions, chloride ions, and plasma gas (argon) adduct ions. As an example of the ion information, mass-charge ratios and natural presence ratios of isotopic ions of cadmium expressed in a table form are shown in FIG. 2. Other elements or compound ions and multivalent ions also store the same information. However, for compound ions and multivalent ions, generation probability (the generation probability relative to the monovalent ions) is stored to replace the presence ratio. Furthermore, here it is set as a table form, but ion information of other forms (such as spectral data) may also be used.

In addition, for multiple elements (target elements) of an object as a constant, the storage part 41 stores a calibration curve (formed by corresponding intensity of a mass peak to content) made by using prepared measurement of a standard sample, a lower limit value of detection thereof (a lower limit value of intensity of a mass peak that the relationship of intensity of a mass peak to content maintains a linear), and a threshold obtained by making the lower limit value several times (e.g., twice). Actions of each functional block will be described later.

Figure 3:
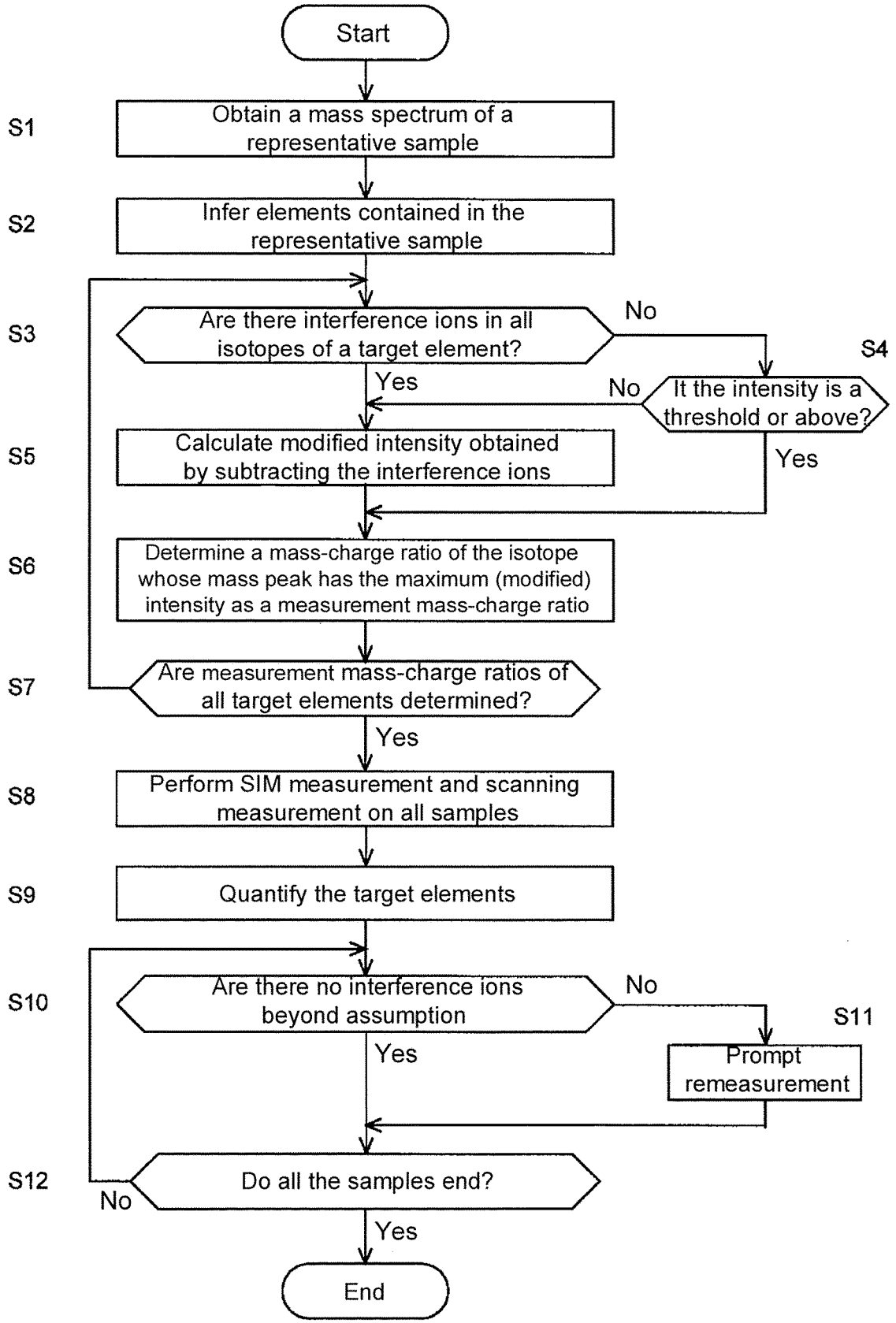
FIG. 3 is a flow chart of a program according to an embodiment of a mass analysis method according to the present invention.

Afterwards, a sample analysis method using the ICP-MS of this embodiment is described by using the flow chart of FIG. 3. Herein, description is made by listing a situation where 10 liquid samples received in the automatic sampler 11 are analyzed.

Firstly, the representative sample measuring part 42 performs scanning measurement on a representative sample as one of the 10 liquid samples. Specifically, the representative sample is imported to the plasma torch 20 from the automatic sampler 11, after atomization and ionization in the plasma torch 20, the mass-charge ratio of the ions penetrating the quadrupole mass filter 321 of the mass analysis part 30 is scanned, and the ions penetrating the quadrupole mass filter 321 are detected by the detector 331. The output data from the detector 331 is transported to the control part 40, and is stored in the storage part 41 together with the mass spectrum data made according to the output data (step S1).

If the mass spectrum data of the representative sample is stored in the storage part 41, the element-containing inferring part 43 infers the element according to the location information (mass-charge ratio) of the mass peak contained in the mass spectrum data (step S2). Specifically, the mass-charge ratio of the mass peak in the mass spectrum data of the representative sample is compared with the ion information (the mass-charge ratios of the isotopic ions of respective elements) stored in the storage part 41, if, for a certain element, all of the peak values of the mass-charge ratio equivalent to the natural isotopes appear, it can be inferred that the element is contained. For example, if the mass peaks exist in all of the positions corresponding to the eight kind of natural isotopes (mass-charge ratios 106, 108, 110, 111, 112, 113, 114, 116) of Cd, the element-containing inferring part 43 infers that the representative sample contains Cd. The element-containing inferring part 43 also performs the same inference on the other elements (containing the elements except for the target element).

If inference on the element contained in the representative sample is finished, the interference ion judgment part 44 determines that the intensity of a mass peak of (the mass-charge ratio of) which kind of isotope is used to quantify each of the target elements (it is Cd here). When the target element is Cd, the interference ion judgment part 44 compares each of the eight kind of natural isotopes with the ion information (mass-charge ratios of isotopic ions, compound ions, and multivalent ions of the elements) stored in the storage 41, and judges whether isobar ions (other ions whose mass-charge ratio is the same as that of the isotope) are present (Step S3).

Figure 4:
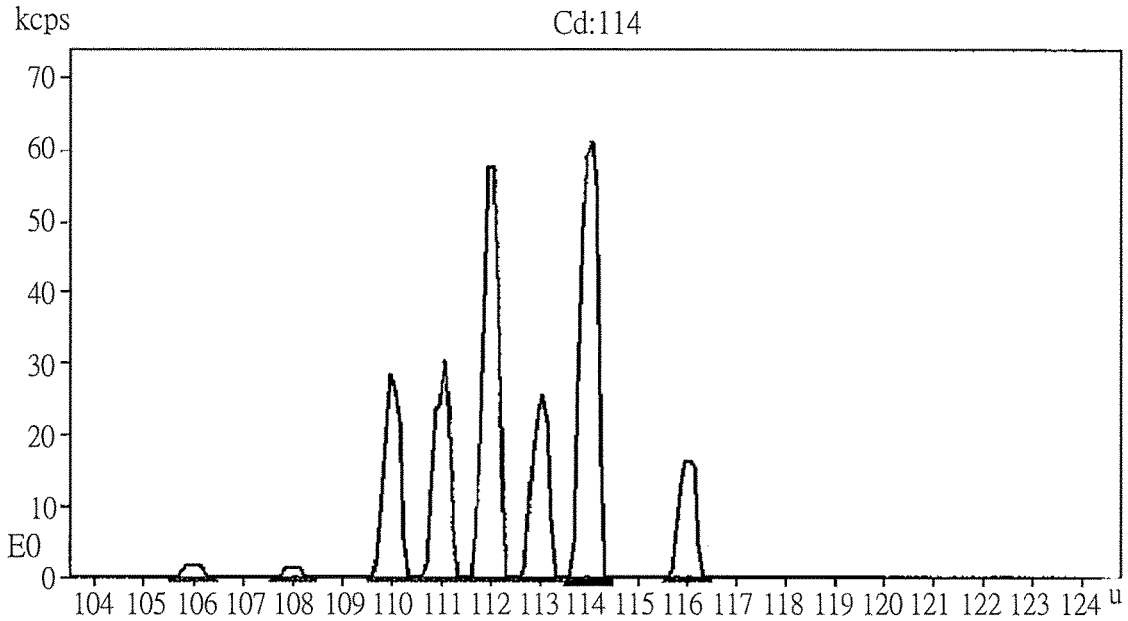
FIG. 4 is a mass spectrum of cadmium.

There are isotopic ions of Sn (mass-charge ratios 112, 114, 116) and isotopic ions of In (mass-charge ratio 113) in the isobar ions (other element ions with the same mass) of Cd, and these ions may become interference ions. In addition, oxide ions of Mo (mass-charge ratios 108, 110, 111, 112, 113, 114, 116) may also become interference ions. FIG. 4 shows a mass spectrum of Cd, FIG. 5(*a*) to FIG. 5(*c*) show a mass spectrum where a mass spectrum of oxides of Sn, In and Mo overlaps on the mass spectrum of Cd.

Herein, as a candidate example with respect to the interference ions of Cd, the ions (the isotopic ions of Sn and In, and the oxide ions of Mo) originating from three types of elements are listed, but in the actually measured mass spectrum data, it can be known that if no mass peak exists in the position of the mass-charge ratio 115, there is no In in the representative sample, in addition, it can be known that if no mass peak exists in positions of the mass-charge ratios 118, 120, there is no Sn in the representative sample (therefore, not included in the elements inferred by the element-containing inferring part 43), so these are excluded from the interference ions. In this embodiment, it is assumed in advance that the ions originating from the three types of elements are considered as candidates of the interference ions, for the mass spectrum data obtained for the representative sample, the situation that there is no mass peak in positions of the mass-charge ratios 115, 118, 120 is described. In this situation, the interference ion relative to Cd is only the oxide ion of Mo.

Figure 5A:
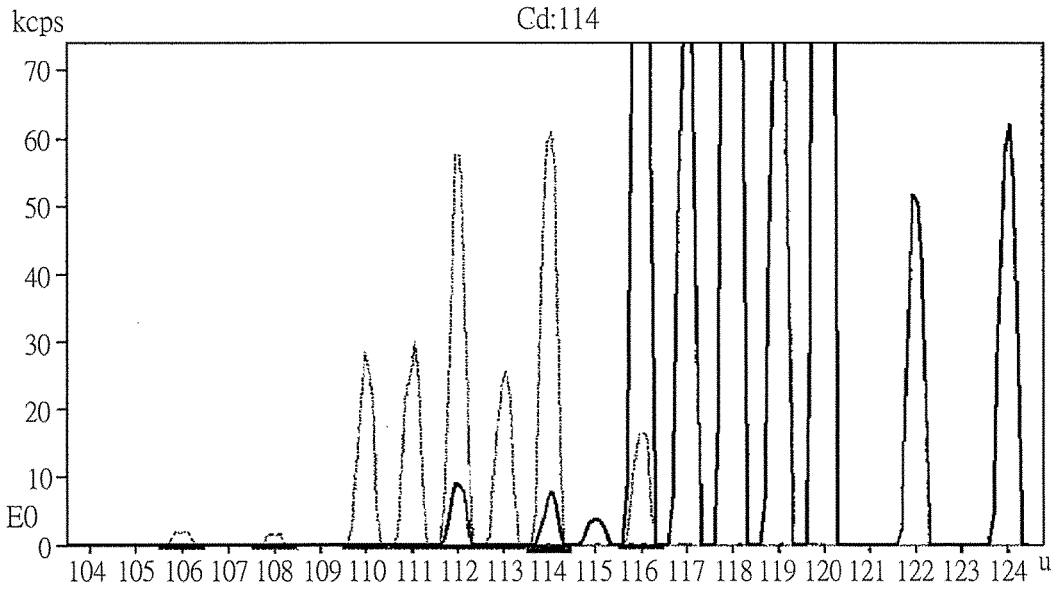
FIG. 5(*a*) to FIG. 5(*c*) are mass spectrums where the mass spectrums of cadmium overlaps with a mass spectrum of interference ions.
Figure 5B:
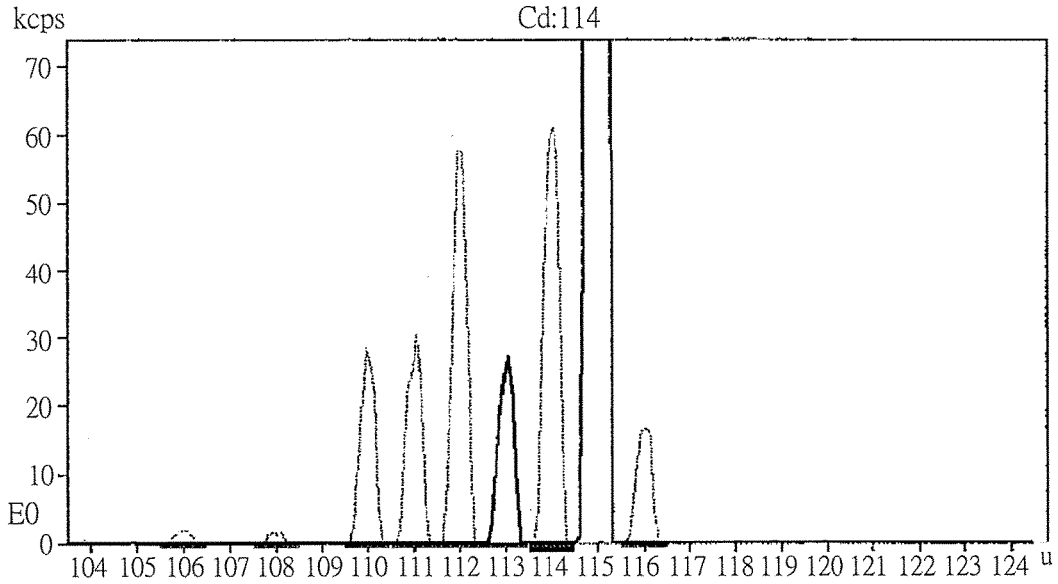
Figure 5C:
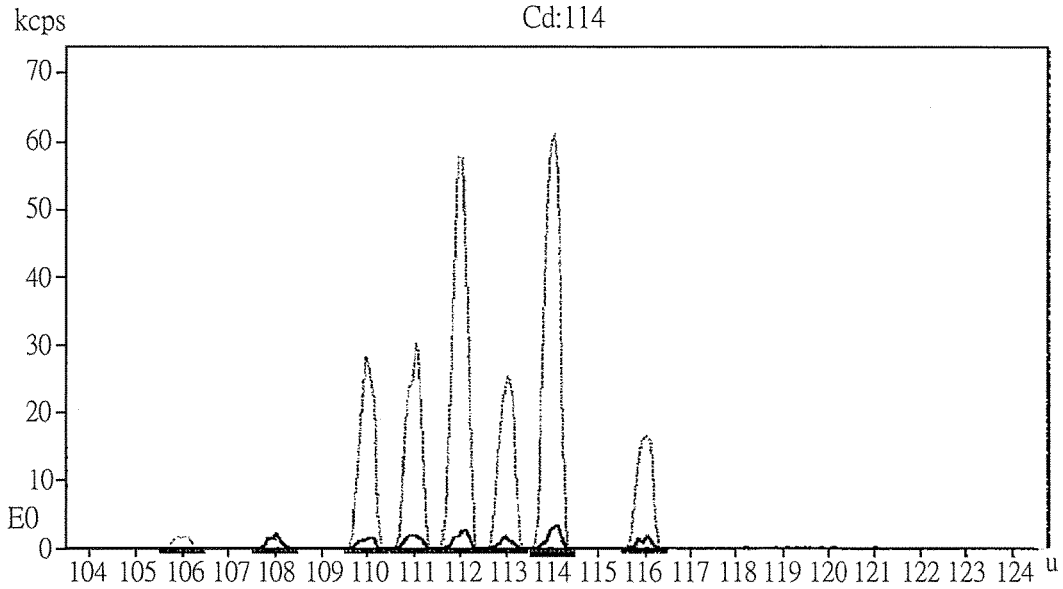
Figure 6:
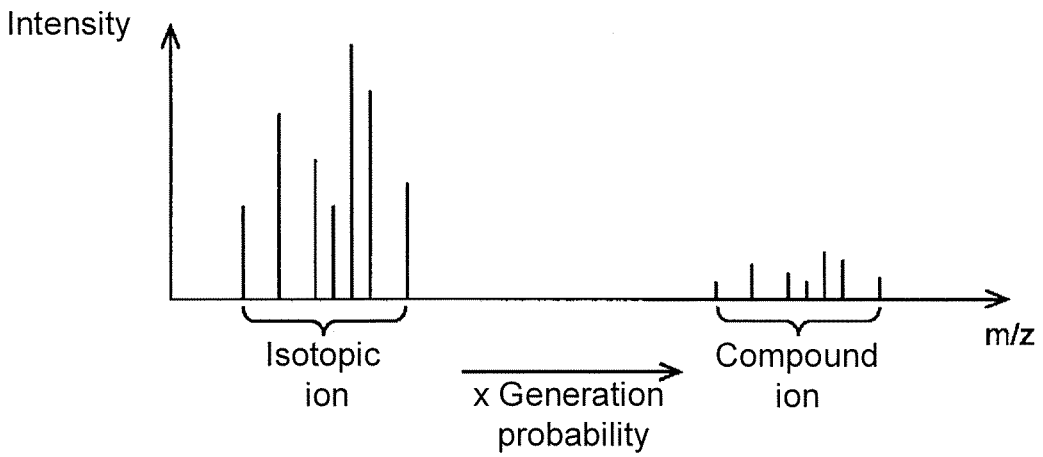
FIG. 6 is a diagram of a method of inferring a mass peak intensity of an interference ion.

If the interference ions (the oxide ions of Mo) for the isotopes of Cd are successively confirmed to exist, it can be known that there is no interference ion in the isotopes of the mass-charge ratio 106 (referring to FIG. 5(*c*)). Therefore, the interference ion judgment part 44 judges that there is no interference ion in the isotopic ions of the mass-charge ratio 106 (it is NO in step S3).

Then, the determination part of measurement mass-charge ratio 45 judges whether the intensity of the mass peak of the isotopic ion is a threshold or above of Cd stored in the storage part 41 (step S4). As mentioned above, the threshold is the intensity value in consideration of the lower limit value of the linear region of the calibration curves of the respective object elements (detection lower limit value). That is, the determination part of measurement mass-charge ratio 45 judges whether Cd can be correctly quantified through the isotopic ions, if the intensity of the mass peak of the isotopic ions is the threshold or above (it is YES in step S4), the mass-charge ratio thereof is determined as the mass-charge ratio used in the measurement of the SIM (the measurement mass-charge ratio) described later. At this moment, if multiple isotopic ions, of which the intensity of the mass peak exceeds the threshold, exist, the mass-charge ratio of the isotopic ion whose mass peak has the maximum intensity is determined as the measurement mass-charge ratio (step S6).

On the other hand, when the interference ion judgment part 44 judges that there are interference ions in all of the isotopic ions (it is YES in step S3), or the intensity of the mass peak of the isotopic ions without interference ions is under the threshold (it is NO in step S4), for each isotopic ion, the determination part of measurement mass-charge ratio 45 calculates the intensity of the mass peak of the interference ion overlapping on the mass peak of the isotopic ion.

As a specific example, the situation that the intensity of the mass peak of the isotopic ion (the mass-charge ratio 106) of Cd is under the threshold is assumed. All of the rest of the isotopic ions overlap with the mass peak of the oxide ions of Mo. The intensity of the oxide ions of Mo overlapping on the mass peak of each isotopic ion may be determined by multiplying the intensity of the mass peak of the isotopic ions (not equivalent to the oxide ions) of Mo by the generation probability of the oxide ions of Mo. On the other hand, for Sn or In (not contained in the representative sample in this embodiment, and thus not needed to be inferred), the mass peaks of the isotopic ions thereof overlap on the mass peaks of the isotopic ions of Cd, so the intensity thereof cannot be determined directly. Therefore, the intensity of the mass peak of the isotopic ions of Sn and In is inferred by dividing the intensity of the mass peak of the compound ions (e.g., the oxide ions) of Sn and In by the generation probability of the compound ions.

The determination part of measurement mass-charge ratio 45 compares the modified intensity among the isotopic ions obtained by subtracting the intensity of the mass peak of the interference ions inferred in this way from the intensity of the mass peak actually measured, and determines the mass-charge ratio of the isotopic ions corresponding to the mass peak with the maximum modified intensity as the measurement mass-charge ratio (step S6). In this embodiment (the situation where the intensity of the mass peak of the ions of the mass-charge ratio 106 is under the threshold), the modified intensity of the isotopic ions is compared with each other in the spectrum shown in FIG. 5(*c*), and the mass-charge ratio 114 with the maximum modified intensity is determined as the mass-charge ratio of Cd. In this way, for all the target elements contained in the representative sample, the determination part of measurement mass-charge ratio 45 successively determines the measurement mass-charge ratio (step S7). At this moment, multiple representative samples can be prepared, and then be measured to obtain the mass spectrum, or to obtain the mass spectrum by multiple measurements. In this situation, for each target element, sometimes multiple candidates may also be listed as the measurement mass-charge ratio. In addition, even if in the case of one representative sample, multiple mass-charge ratios can be set as the measurement mass-charge ratios in order from high to low of the intensity (or the modified intensity) of the mass peak.

After the determination of the measurement mass-charge ratio for all of the target elements, the all-sample measuring part 46 imports all of the samples successively from the automatic sampler 11, and performs scanning measurement and SIM measurement on each sample (step S8). As the measurement mass-charge ratio of the target element, usually the ion determined in step S7 is directly designated and then the SIM measurement is performed, but, besides, the measurement mass-charge ratios desired by the user can also be set additionally. At this moment, when the measurement mass-charge ratios of the target element are the influents containing the interference ions, the SIM measurement will also be performed on the mass-charge ratios of other monovalent ions corresponding to the interference ions (which are monovalent compound ions when the isobar ions exist in all of the monovalent ions). In the situation of this embodiment, the SIM measurement will also be performed on the monovalent ions, corresponding to the oxide ions of Mo of the mass-charge ratio 114, of the isotopes of Mo with the mass-charge ratio 98 (=114-16). For each sample, the mass spectrum obtained by scanning measurement, and the intensity data of the ions such as the measurement mass-charge ratios of each target element obtained by the SIM measurement are stored in the storage part 41.

If the scanning measurement and the SIM measurement for all of the samples are completed, the element quantitative part 49 reads the calibration curves of each target element stored in the storage part 41, and quantifies Cd according to the ion intensity of the mass-charge ratio 114 obtained by the SIM measurement (step S9). However, in this embodiment, as mentioned above, mass peaks of the oxide ions of Mo as the interference ions overlap on the mass peaks of Cd. Therefore, before the quantification, the modified intensity calculation part 48 calculates the value obtained by multiplying the intensity of the mass peak of the monovalent ions of Mo by the generation probability of the oxide ions, and after calculating the modified intensity obtained by subtracting the value (the intensity of the mass peak of the interference ions) from the intensity of the mass peak actually measured, the element quantitative part 49 quantifies Cd according to the modified intensity. Other target elements are also be quantified in the same way. At this moment, when multiple measurement mass-charge ratios are set for each target element, the target element is quantified by using each measurement mass-charge ratio.

Afterwards, the judgment part of interference ion beyond assumption 47 confirms whether interference ions (interference ions beyond assumption), except for the interference ions determined in steps S2-S7, overlap on the mass peak of the measurement mass-charge ratio of each target element of the mass spectrum obtained from each sample (S10). In this embodiment, it is determined whether mass peaks of ions, except for the oxide ions of Mo considered as the interference ions, overlap on the mass peaks of the measurement mass-charge ratio 114 of Cd. And, when the ion except for the oxide ions of Mo exists, the ion is considered as "the interference ion beyond assumption".

The confirmation of the interference ion beyond assumption is performed in the following way. As mentioned above, when it is determined that the mass-charge ratio of Cd is 114, it is confirmed that there is no monovalent ion of In contained according to that no mass peak exists in the position of the mass-charge ratio 115, and it is confirmed that there is no monovalent ion of Sn contained according to that no mass peak exists in the positions of the mass-charge ratios 118, 120. Herein, whether mass peaks exist in positions of the mass-charge ratios 115, 118, 120 may also be confirmed, if it is confirmed that there is no mass peak in the position like the mass peak of the representative sample, it can be known that there are no Sn and In in the sample. In addition, it can be known that if near the position (mass-charge ratio), of subtracting the number of mass (increasing number of mass, such as 35, 37 in the situation of the chloride ions) increased due to the compound ions possibly generated from the measurement mass-charge ratio 114, there is no mass peak pattern of the intensity of the presence ratio of the isotope corresponding to other elements, there are also no compound ions beyond assumption.

If it is confirmed that there is no interference ion beyond assumption exists in any target element, it is confirmed whether the intensity of the mass peak of the target element, obtained by subtracting the intensity of the mass peak of the interference ions confirmed in steps S2-S7, is no less than the detection lower limit of the calibration curves of the element. In this embodiment, it is confirmed whether the intensity (the modified intensity) obtained by subtracting the intensity of the mass peak of the oxide ions of Mo (as the value obtained by multiplying the intensity of the mass peak of the monovalent ions of Mo appearing at the mass-charge ratio 98 by the generation probability of the oxide) as the interference ions from the intensity of the mass peak of the measurement mass-charge ratio of Cd.

On the other hand, when there is a mass peak at the position of the mass-charge ratio 115, there may include In (the interference ion beyond assumption), when there is a mass peak in the positions of the mass-charge ratios 118, 120, there may include Sn (the interference ion beyond assumption). In addition, when there are isotope patterns of the specific element appearing in the region of subtracting the increased mass number of the compound ions, there may include the compound ions (the interference ions beyond assumption) of the element (it is No in step S10). In this situation, there are mass peaks of the interference ion beyond assumption overlapping on the mass peak of the mass-charge ratio 114 obtained by the SIM measurement, and if direct quantification is performed, mistakes may be generated. Therefore, in order to make this situation known by the analyzer, the remeasurement prompting part 50, for the sample (e.g., sample X), displays the information, whose key points are that the interference ions beyond assumption about the target element (Cd) are probably contained and remeasurement will be performed preferably, on the display portion 70 (step S11, FIG. 7). For each sample, the steps from step S9 to step 11 are repeated, until the confirmation of whether there are interference ions beyond assumption about each target element of all the samples ends (step S12).

Figure 7:
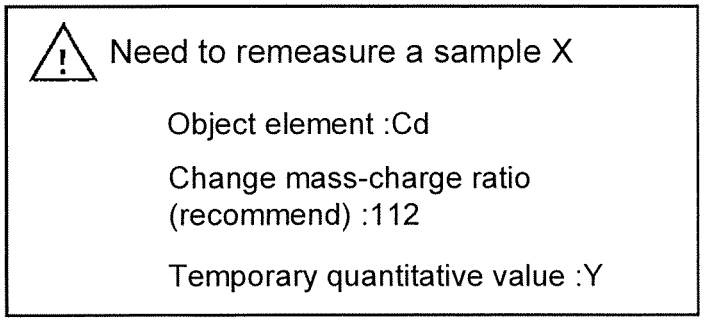
FIG. 7 is an example of image display in the presence of interference ions beyond assumption.

In step S11, the information is displayed, and the prompting part of changed mass-charge ratio 51, for the sample, determines a new measurement mass-charge ratio (changed mass-charge ratio) (e.g., 112) through a program, which is the same as that in step S2 to step S7, on the representative sample, and displays it as a recommend measurement mass-charge ratio on the display portion 70 together with the information (FIG. 7). For the target elements in which interference ions beyond assumption are found, the analyzer performs remeasurement (SIM measurement) using the changed mass-charge ratio, and thus can quantify the target element. Alternatively, the process may also return to the step S1, to use the sample as a representative sample to perform each step (however, when it is found that there is only one sample of the interference ions beyond assumption, it is possible to determine the measurement mass-charge ratio of the target elements and perform SIM measurement only for the sample).

Then, the prompting part of temporary quantitative value 52 uses the changed mass-charge ratio, calculates a temporary quantitative value according to a mass spectrum obtained for the sample, and displays the value as the temporary quantitative value on the display portion 70 (FIG. 7). The reason for setting the value as a "temporary" quantitative value is that: the quantitative value is a quantitative value obtained according to the intensity of the mass peak of the mass spectrum, and the quantification precision is low if compared with the quantitative value calculated according to the intensity of the mass peak obtained by SIM measurement (the intensity obtained by measuring the ion of the measurement mass-charge ratio for a sufficiently necessary time). Even so, in a situation that the mass peak intensity in the mass spectrum is sufficiently greater than the detection lower limit value or in a situation that a strict quantitative value of the target element is not required, the temporary quantitative value may also be directly used as the quantitative value of the target element.

In addition, when multiple measurement mass-charge ratios are set for each target element, sometimes interference ions beyond assumption are present in a part thereof. Therefore, when the multiple measurement mass-charge ratios are used to calculate a quantitative value, a proper quantitative value calculated with which measurement mass-charge ratio can be indicated.

In the mass analysis method and the ICP-MS of the embodiments, after a mass spectrum of a representative sample is obtained, the interference ion judgment part judges whether there are interference ions according to ion information pre-stored in the storage part 41, and then the determination part of measurement mass-charge ratio determines the most suitable measurement mass-charge ratio. Therefore, SIM measurement using the most suitable measurement mass-charge ratio can be performed regardless of the analyzer's degree of proficiency, and each target element contained in each sample can be quantified correctly.

In addition, SIM measurement is also performed on mass-charge ratios of monovalent ions of interference elements corresponding to interference ions, detection intensity of the interference ions is inferred, and modified intensity obtained by subtracting the interference ions from actually measured intensity of a mass peaks of ions of mass-charge ratios of target elements is calculated, and thus the actually measured intensity can be modified automatically without bothering the analyzer, and intensity of a mass peaks of the target elements is obtained easily.

Then, in the mass analysis method and the ICP-MS of this embodiment, whether there are interference ions beyond assumption is confirmed using the mass spectrum obtained for each sample and the ion information, and when there are interference ions beyond assumption, the analyzer is urged for remeasurement, which can thus prevent errors in the quantitative result of the target element.

The embodiment is only an example, and can be properly changed according to the purport of the present invention. The embodiment only describes Cd for ease of understanding, but may also quantify other elements in the same way. In addition, as an example of the interference ions, only In, Sn, and oxides of Mo are listed, but ions of elements other than these or other compound ions that can be generated by chloride ions, hydroxide ions, multivalent ions and the like are considered as interference ions, and whether there are interference ions may be processed through the same program. In addition, in the embodiment, a quadrupole mass filter is used in the mass analysis part 30, but other multipole mass filters may also be used.

What is claimed is:

1. A mass analysis method, which is a method that uses an Inductively Coupled Plasma Mass Spectrometer (ICP-MS) to measure pre-determined one or more target elements for multiple measuring object samples, the ICP-MS having a plasma ionization part that plasma-ionizes the measuring object samples through an ICP and a mass analysis part that mass-separates ions generated in the plasma ionization part and detects the ions, wherein the mass analysis method comprises:

plasma-ionizing, in the plasma ionization part, a representative sample as one of the multiple measuring object samples, and obtaining a mass spectrum by scanning measurement in the mass analysis part, inferring types of elements contained in the representative sample according to the position of a mass peak of the representative sample, for respective ones of the target elements in the inferred elements, judging according to ion information whether there are isotopes without interference ions, wherein the ion information is information about mass-charge ratios and presence ratios of isotopic ions of all elements assumptively contained in the measuring object samples, which contain the target elements, and mass-charge ratios and generation probabilities of compound ions and multivalent ions assumptively generated when the measuring object samples are plasma-ionized, and the interference ions are other ions having a mass-charge ratio identical with that of monovalent ions of the target elements, when there are the isotopes without the interference ions, determining the mass-charge ratio of the isotope whose a mass peak has the maximum intensity as a measurement mass-charge ratio being a mass-charge ratio for measurement of the target elements, and when the interference ions are present in all the isotopes, based on the ion information, calculating intensity of the mass peak of the interference ions according to detection intensity of monovalent ions of interference elements, and determining a mass-charge ratio of an isotope whose a mass peak has the maximum intensity obtained by subtracting the intensity as a measurement mass-charge ratio being a mass-charge ratio for measurement, wherein the interference elements are elements corresponding to the interference ions, and sequentially introducing the multiple measuring object samples into the plasma ionization part, and performing selected ion monitoring (SIM) measurement, which uses the measurement mass-charge ratio, on each sample.

2. The mass analysis method according to claim 1, wherein, regarding the measurement mass-charge ratio of the target element, when an interference ion is present, the SIM measurement is also performed on a mass-charge ratio of a monovalent ion of an interference element corresponding to the interference ion, and based on the ion information, detection intensity of the interference ion is inferred according to detection intensity of the monovalent ion of the interference element, and modified intensity as intensity obtained by subtracting intensity of a mass peak of the interference ion from intensity of a mass peak of an ion of the mass-charge ratio of the target element is calculated.

3. The mass analysis method according to claim 1, wherein a mass spectrum is obtained also by scanning measurement on measuring object samples other than the representative sample, according to the obtained mass spectrum and the ion information for each measuring object sample, it is judged, for respective ones of the target elements, whether an interference ion beyond assumption is present in determination of the measurement mass-charge ratio, and when at least one of the target elements has the interference ion beyond assumption, information of urging remeasurement is prompted to an analyzer for the measuring object sample.

4. The mass analysis method according to claim 3, wherein, when it is judged for a target element that the interference ion beyond assumption is present in determination of the measurement mass-charge ratio, a changed mass-charge ratio as a new mass-charge ratio for measurement of the target element is determined and prompted to the analyzer according to the mass spectrum of the measuring object sample and the ion information.

5. The mass analysis method according to claim 4, wherein the changed mass-charge ratio is prompted, the target element is quantified according to intensity of a mass peak of the changed mass-charge ratio in the mass spectrum of the measuring object sample, and a quantitative value thereof is prompted as a temporary quantitative value.

6. An Inductively Coupled Plasma Mass Spectrometer (ICP-MS), for measuring pre-determined one or more target elements for multiple measuring object samples, the ICP-MS comprising:

a) a plasma ionization part that plasma-ionizes the measuring object samples through an ICP;

b) a mass analysis part that mass-separates ions generated in the plasma ionization part and detects the ions;

c) a storage part that stores ion information, wherein the ion information is information about mass-charge ratios and presence ratios of isotopic ions of all elements assumptively contained in the measuring object samples, which contain the target elements, and mass-charge ratios and generation probabilities of compound ions and multivalent ions assumptively generated when the measuring object samples are plasma-ionized;

d) a representative sample measuring part that plasma-ionizes, in the plasma ionization part, a representative sample as one of the multiple measuring object samples, and obtains a mass spectrum by scanning measurement in the mass analysis part;

e) an element-containing inferring part that infers types of elements contained in the representative sample according to the position of a mass peak of the representative sample;

f) an interference ion judgment part that, for respective ones of the target elements in the inferred elements, judges according to ion information whether there are isotopes without interference ions, wherein the interference ions are other ions having a mass-charge ratio identical with that of monovalent ions of the target elements;

g) a determination part of measurement mass-charge ratio that, when there are the isotopes without the interference ions, determines the mass-charge ratio of the isotope whose a mass peak has the maximum intensity as a measurement mass-charge ratio being a mass-charge ratio for measurement of the target elements, and when the interference ions are present in all the isotopes, based on the ion information, calculates intensity of the mass peak of the interference ions according to detection intensity of monovalent ions of interference elements, and determines a mass-charge ratio of an isotope whose a mass peak has the maximum intensity obtained by subtracting the intensity as a measurement mass-charge ratio being a mass-charge ratio for measurement, wherein the interference elements are elements corresponding to the interference ions; and h) an all-sample measuring part that sequentially introduces the multiple measuring object samples into the plasma ionization part, and performs selected ion monitoring (SIM) measurement, which uses the measurement mass-charge ratio, on each sample.

7. The ICP-MS according to claim 6, wherein, regarding the measurement mass-charge ratio of the target element, when an interference ion is present, the SIM measurement is also performed on a mass-charge ratio of a monovalent ion of an interference element corresponding to the interference ion by the all-sample measuring part, and the ICP-MS further comprises:

i) a modified intensity calculation part that infers, based on the ion information, detection intensity of the interference ion according to detection intensity of the monovalent ion of the interference element, and calculates modified intensity as intensity obtained by subtracting intensity of a mass peak of the interference ion from intensity of a mass peak of an ion of the mass-charge ratio of the target element.

8. The ICP-MS according to claim 6, wherein the all-sample measuring part obtains a mass spectrum also by scanning measurement on measuring object samples other than the representative sample, and the ICP-MS further comprises:

j) a judgment part of interference ion beyond assumption that judges, according to the obtained mass spectrum and the ion information for each measuring object sample, for respective ones of the target elements, whether an interference ion beyond assumption is present in determination of the measurement mass-charge ratio; and k) a remeasurement prompting part that prompts, when at least one of the target elements has the interference ion beyond assumption, information of urging remeasurement to an analyzer for the measuring object sample.

9. The ICP-MS according to claim 8, comprising: 1) a prompting part of changed mass-charge ratio that, when it is judged for a target element that the interference ion beyond assumption is present in determination of the measurement mass-charge ratio, determines and prompts, according to the mass spectrum of the measuring object sample and the ion information, a changed mass-charge ratio as a new mass-charge ratio for measurement of the target element to the analyzer.

10. The ICP-MS according to claim 9, comprising: m) a prompting part of temporary quantitative value that prompts the changed mass-charge ratio, quantifies the target element according to intensity of a mass peak of the changed mass-charge ratio in the mass spectrum of the measuring object sample, and prompts a quantitative value thereof as a temporary quantitative value.

* * * * *